United States Patent [19]

Kohlhepp

[11] 4,310,096

[45] Jan. 12, 1982

[54] WALL CLOTHES HANGER

[76] Inventor: Heinrich Kohlhepp, Rathausstrasse 14, 6433 Philippsthal, Werra, Fed. Rep. of Germany

[21] Appl. No.: 145,849

[22] Filed: May 1, 1980

[51] Int. Cl.[3] ..... A47F 7/06; A47F 7/19

[52] U.S. Cl. ..... 211/88; 211/32; 223/88; 223/95

[58] Field of Search ..... 211/87, 88, 86, 32, 211/118, 30; 223/88, 92, 95

[56] References Cited

U.S. PATENT DOCUMENTS

| | | | |
|---|---|---|---|
| 909,114 | 1/1909 | Pitts | 211/32 |
| 1,143,693 | 6/1915 | Down | 211/32 |
| 1,722,757 | 7/1929 | Levine | 211/87 |
| 1,736,218 | 11/1929 | Pilat | 211/87 |
| 2,103,642 | 12/1937 | Roller | 211/87 |
| 2,500,881 | 3/1950 | Stader | 211/87 |
| 2,596,287 | 5/1952 | Richardson | 211/32 |
| 4,233,911 | 11/1980 | Vignale | 211/88 |

*Primary Examiner*—Reinaldo P. Machado

[57] ABSTRACT

A multi-functional clothes hanger adapted for wall mounting comprises a rear mounting bracket having an upper shelf portion for receiving small articles extending outwardly therefrom, an upper portion extending outwardly from beneath the small article receptacle and curving upwardly therefrom terminating in a recessed hook portion to receive a hat or coat hanger thereon, and a pants hanger affixed to the bracket at one end with an intermediate portion extending outwardly therefrom and an outer portion with a free end extending substantially parallel to the bracket. The clothes hanger also includes a recessed central portion in the bracket adapted to receive the mating upper end of a multi-purpose hanger with a portion thereof located in a slot in the upper portion and an outwardly projecting members at the outer ends of the multi-purpose hanger to accommodate coat hooks and the like.

4 Claims, 4 Drawing Figures

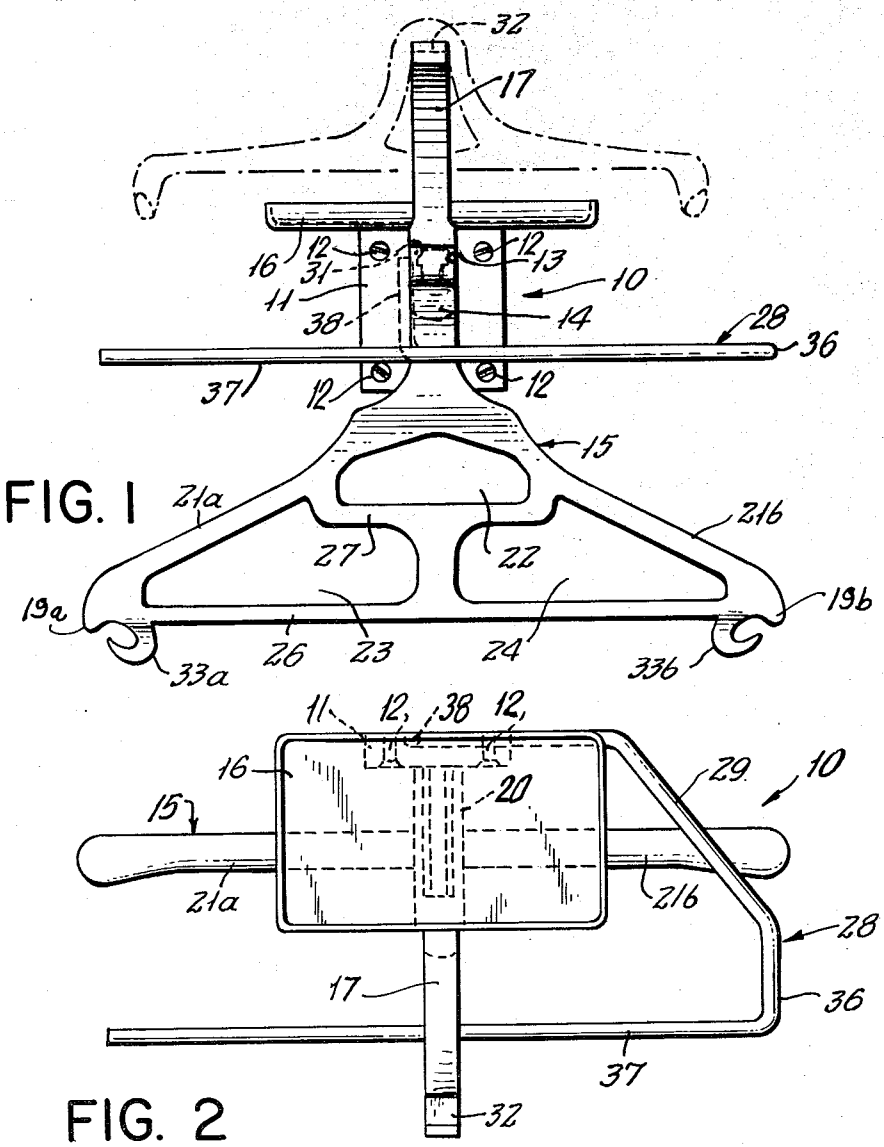
FIG. 1
FIG. 2
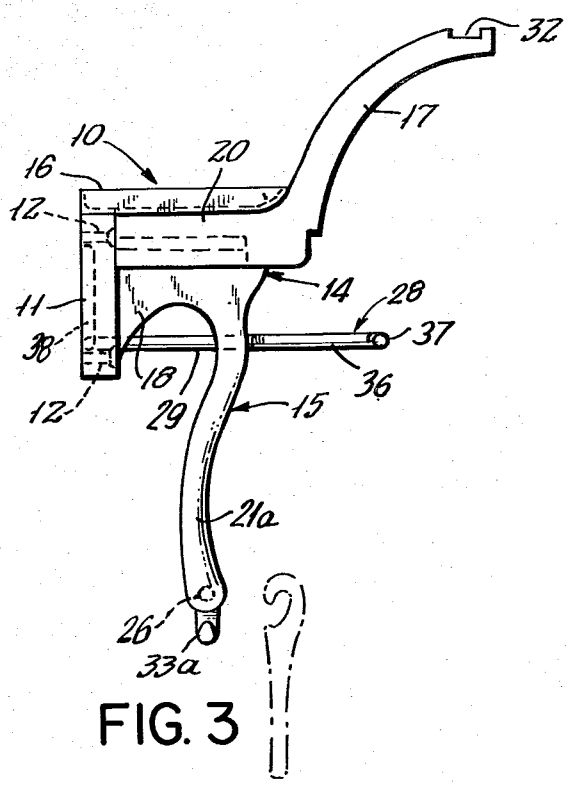
FIG. 3
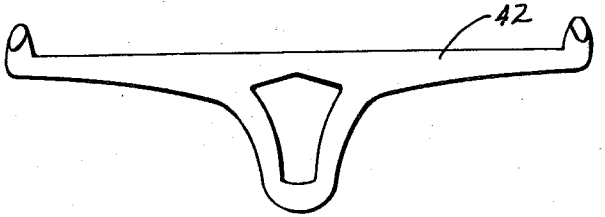
FIG. 4

WALL CLOTHES HANGER

BACKGROUND OF THE INVENTION

The present invention relates to clothes hangers and particularly to new and improved wall mounted clothes hangers serving a plurality of functions.

Generally, the conventional clothes hanger includes an upper hook, outwardly extending shoulder portions to receive a jacket and a cross-member joining the outer ends of said shoulder portions which can be utilized for hanging pants. In commercial establishments, it is desirable to have a permanently affixed clothes hanger to prevent removal from the premises and the same time it is necessary to utilize as little space as possible. The present invention is mounted to a wall and provides facilities for hanging coats, pants and hats, etc. as well as facilities for small articles in one unified arrangement. The rather conventional prior art arrangements do not have the flexibility of the subject wall hanger nor can they serve as many functions. The subject clothes hanger is readily mounted in place and rather economical in construction.

SUMMARY OF THE INVENTION

The present invention discloses a wall clothes hanger which is multi-functional. The clothes hanger accepts jackets, coats, shirts, ties, shawls and the like and also includes a pants hanger which is open on one end so that pants can be easily hung and removed. A further feature involves a flat surface for receiving small articles which can be used for various items normally carried in pockets.

The wall hanger comprises a rear bracket which is normally affixed to a wall and includes an outwardly projecting small particle receptacle along the upper surface thereof, an outer upwardly projecting curved portion having a hook at the end part thereof for receiving either a hat or a hanger. A downwardly extending universal hanger is also mounted to the bracket and includes projecting portions at the outer ends thereof to serve as coat hooks or engage additional hangers. A pants hanger is also mounted to the bracket and projects outwardly therefrom in a predetermined convenient configuration. The universal hanger includes an upwardly protruding portion which is mounted in a slot in the upper member which is exposed through a recess in the bracket by merely inserting said protruding portion. The universal hanger normally includes a multi-purpose body portion with shoulder portions for jackets as well as coat hooks, tie holders and pants hanger facilities.

Accordingly, an object of this invention is to provide a new and improved wall hanger.

Another object of this invention is to provide a new and improved wall hanger which includes facilities for holding various articles of clothing as well as small articles.

A more specific object of this invention is to provide a new and improved wall hanger which is versatile, economical in space and includes couplings for various hanger attachments depending upon the clothing which is to be stored in connection therewith.

DESCRIPTION OF THE DRAWINGS

Other objects and advantages of this invention may be clearly seen when viewed in conjunction with the accompanying drawings wherein:

FIG. 1 is a front view of the wall hanger comprising the present invention with a possible hanger attachment shown in phantom;

FIG. 2 is a top view of the wall hanger shown in FIG. 1 with portions shown in dashed lines to more clearly illustrate the construction thereof.

FIG. 3 is a side view of the invention as illustrated in FIG. 1, and,

FIG. 4 is a hanger which may be utilized in connection with the lower portion of the hanger in FIG. 3.

DETAILED DESCRIPTION OF THE INVENTION

Referring now to the drawings, the invention comprises a wall hanger 10 comprising a rear bracket 11 which is secured to a wall (not shown) by screws 12. The bracket 11 includes a forward recess 13 which is designed to accept the rotatable projecting upper portion 14 of a universal hanger 15. The hanger 10 also includes a horizontal shelf portion 16 mounted on the upper portion of the bracket 11 and extending outwardly therefrom to receive small articles, for example, articles from one's pocket such as keys, change etc.

A curved upwardly projecting portion 17 includes a rear portion 20 which extends beneath the shelf 16 and is secured thereto. The rear portion 20 includes a slot 31 which is exposed through the recess 13 and serves to lock the upper portion 14 of the hanger 15 in place. The outer extremity of the projecting portion 17 includes a recess 32 which may be engaged by a hanger or alternatively the curved portion itself may be utilized to hold hats and the like.

The hanger 15 includes a rear portion 18 which contacts the wall bracket 11 for support. The hanger 15 also includes shoulder portions 21*a* and *b* to receive a jacket and projecting portions 19 at the outer extremities of the shoulders 32. The apertures 22, 23 and 24 may be utilized for holding ties, scarves, etc., which are draped over the supporting members 26 and 27. Coat hooks 33*a* and 33*b* are located at the outer ends of cross member 26.

A pants hanger 28 is mounted to the bracket 11 and includes rear portion 38 and outwardly extending portions 29 and 36 and a holder portion 37 extending substantially parallel to the wall at a spaced distance therefrom. The holder portion 37 is open at one end to receive a pair of pants.

The invention as thus described involves a flexible, multifunctional clothes hanger which occupies a minimum of space. The projecting portion 17 may be used in conjunction with a hanger 41 shown in phantom in FIG. 1, or the upper end may be used to hold hats, helmets, morning coats or underwear. The flat shelf 16 may be used to hold small parts or umbrellas, while the hanger 15 may be used in a conventional manner to hold shirts, etc. The pants holder 28 extends outwardly from the wall in a predetermined configuration providing additional flexibility. Finally, the hanger A2 of FIG. 4 may be used as a pants holder.

It is understood that the above-described arrangements are merely illustrative examples of the application. Numerous other arrangements may be readily devised by those skilled in the art which will embody the principles of the invention and fall within the spirit and scope thereof.

I claim:

1. A wall clothes hanger comprising:

a rear mounting bracket for fixation to a wall having a central recess therein, an upper shelf portion mounted to the top of the bracket and extending outwardly therefrom, a member extending upwardly in a curve from beneath the shelf to accommodate hats and the like and having a rear portion extending beneath the shelf to the wall bracket and including a slot therein, a pants hanger comprising a metal bar extending outwardly from the wall bracket and having an end portion extending substantially parallel to said wall, and a universal hanger having an upwardly projecting portion for engagement with the slot in the upper member within the recess in the wall bracket.

2. A wall clothes hanger in accordance with claim 1 wherein:

the curved upwardly extending member includes a transverse slot adjacent to the outer end to receive a hanger.

3. A wall clothes hanger in accordance with claim 1 wherein:

the universal hanger includes outwardly extending shoulder portions and upper and lower transverse members joining said shoulder portions and forming predetermined apertures therebetween and wherein the shoulder portions include hanger hooks at the ends thereof for engagement with hangers.

4. A wall clothes hanger in accordance with claim 3 further including:

a detachable hanger comprising a transverse member having hanger hooks at the ends thereof to engage the hanger hooks on the transverse member and further including a central downwardly extending portion having an aperture therethrough for holding purposes.

* * * * *